US005104074A

United States Patent [19]

Malloy

[11] Patent Number: 5,104,074

[45] Date of Patent: Apr. 14, 1992

[54] FENCE SUPPORT

[76] Inventor: James T. Malloy, 50 Swede Creek Rd., Oak Run, Calif. 96069

[21] Appl. No.: 370,802

[22] Filed: Jun. 23, 1989

[51] Int. Cl.[5] ..... F16M 13/00

[52] U.S. Cl. ..... 248/156; 248/545; 248/165; 248/170; 52/156; 156/63; 156/64; 156/DIG. 5

[58] Field of Search ..... 248/156, 545, 530, 165, 248/170; 52/155-158, 165; 256/63, 64, 36, DIG. 5

[56] References Cited

U.S. PATENT DOCUMENTS

| | | | |
|---|---|---|---|
| 511,458 | 12/1893 | Riter | 256/35 |
| 542,976 | 7/1895 | Mesnard | 52/157 X |
| 673,256 | 4/1901 | Hamett | 256/36 |
| 741,095 | 10/1903 | Bayless | 256/63 |
| 2,826,281 | 3/1958 | Johnson | 52/158 |
| 3,937,436 | 2/1976 | Stewart | 52/155 X |
| 4,342,179 | 8/1982 | Hill | 52/155 |
| 4,712,762 | 12/1987 | Liedle | 248/545 X |

FOREIGN PATENT DOCUMENTS

| | | | |
|---|---|---|---|
| 158396 | 2/1905 | Fed. Rep. of Germany | 248/170 |
| 1122613 | 9/1956 | France | 116/63 R |
| 1440402 | 12/1961 | France | 256/36 |
| 1557852 | 2/1969 | France | 248/530 |
| 2396143 | 3/1979 | France | 52/165 |
| 700943 | 12/1953 | United Kingdom | 52/158 |

*Primary Examiner*—Alvin C. Chin-Shue

*Attorney, Agent, or Firm*—Plante, Strauss, Vanderburgh & Connors

[57] ABSTRACT

Disclosed is a fence support including a generally vertically oriented main support post 31 in the form of a T shaped iron bar and a pair of braces 18. Each brace 18 includes an elongated bearing element 26 that is received in the bites of the T and a collar member 25 fits over the top of the main support post 31 and bearing elements 26 to hold them together. The braces 18 have at their bottom ends stake holders 16 and 17 which receive stakes 23 that are driven into the ground. An anchor 24 holds the main support post 31 in position.

1 Claim, 7 Drawing Sheets

FENCE SUPPORT

BACKGROUND OF THE INVENTION

1. Field of the Invention

This invention relates to a fence support that is inexpensive and may be easily and quickly installed.

2. Background Discussion

Typical rural fences consist of a fencing material such as wired type mesh or barbed wire stretched over posts made of wood or metal. These posts are either driven into the ground with sledgehammers or powered or manual drivers, or a hole is dug into the ground, the post is inserted into the hole, and then concrete is poured into the hole and allowed to harden. Installing such fence posts is both laborious and time consuming For example, it normally takes about an hour to install a post by digging a hole, inserting the post, and pouring in the concrete.

It is sometimes desirable to brace the post using, for example, angle iron, a tee post, or tubing. One end of the brace is bolted to the top of the post and the other end is inserted into a hole in the ground and filled with concrete. A right triangle is formed, with the post and surface of the ground being the legs of triangle and the brace being the hypothenuse. Sometimes the braces pounded into the ground and then bolted or welded to the top of the post. This requires some skill and luck to make the brace intersect the top of the post at the desired position and angle. Frequently, the brace does not end up were desired.

If the post is not in the ground deep enough, or if the ground is soft, for example sandy or wet, the post is pulled from the ground when the fencing material is stretched from the post. The braces remain in place, but the post rises from the ground in much the same way that a pole vaulter is vaulted from the ground when he makes his jump. When this happens there is not a good solution. Typically, sand bags or rocks are placed around the post and positioned to exert a force in a direction opposite to the force being exerted by the stretched fencing material.

SUMMARY OF THE INVENTION

The present invention provides a fence support which is inexpensive to manufacture, is light weight, is easy to transport to remote locations, and is easily and quickly installed in the field. Typically, an average person can assemble the fence support of this invention within less than five minutes. The support of this invention comes in a kit disassembled, and is assembled in the field to provide a very sturdy support that can withstand very high loads. The ability of the support of this invention to carry high loads is surprising considering that it is so light weight and does not employ and concrete footing like conventional fence posts.

There are several features of this invention, no single one of which is solely responsible for its desirable attributes. Without limiting the scope of this invention as expressed by the claims, its more prominent features will now be discussed briefly. After considering this discussion, and particularly after reading the section of this application entitled "DETAILED DESCRIPTION OF THE PREFERRED EMBODIMENTS," one will understand how the features of this invention provide its advantages.

The first feature of this invention is that it is composed of three principal parts: a main support post and a pair of braces. These principal parts are in a kit and disassembled. The kit also includes stacks which are used to secure the bottom ends of the main support post and braces to the ground. The kit may also include an anchor for the main support post. These principal parts may be assembled into two different types of support structures: a line support and a corner support.

The second feature is that the principal parts of this invention are designed so that they may be easily assembled in the field into a structure that provides the necessary rigidity to allow the fencing material to be strung from one fence support to another without collapse of the fence support and without the need to dig holes and pour concrete, or to drive the main support member deep into the ground.

The third feature is that the main support post and two braces are assembled in the field into a three legged structure that is extremely and surprisingly sturdy, being able to carry very heavy loads. The top ends of the main support post and braces are rigidly and fixedly joined together, with the main support post in a vertical position and each of the two braces extending downwardly and outwardly from the top end of the main support post to form an acute angle with respect to the vertically oriented main support post.

The forth feature is that the main support post has at its top end a pair of mating sections and the braces each have at their tops ends an elongated bearing element. Upon assembly, the bearing elements engage the mating sections and a cap member is force fitted over the top of the main support member and elongated bearing elements to hold them rigidly and fixedly together.

The fifth feature is that the braces have at their bottom ends stake holder means. Stakes are received in these stake holder means and are driven into the ground. The stake holder means may include one or more stack holding elements. When the fence support is used as a corner support, the braces each have two stake holding elements. One element is parallel with the vertically oriented main support member, and the other is biased at an acute angle with respect to the main support member. The soil condition governs the angularity of the biased stake holding element. If the soil in which the stake is to be driven is soft, for example is sandy, the angle is about 45° or even greater with respect to the vertically oriented main support member. If the soil is hard, for example clay, the angle is about 15°. It has been found that if this acute angle is about 15 degrees, a very rigid structure is provided and can withstand relatively high loads. If the fence support is to be used as a line support, only the parallel stake holding element is employed. Optionally, the main support member may have at its bottom end an anchor, including stake holder means which receive stakes that are driven into the ground.

The sixth feature of this invention is that the elongated bearing elements may be mounted by hinges to the braces, so that the angular relationship between the braces and the main support member can be adjusted to accommodate hilly terrain.

BRIEF DESCRIPTION OF THE DRAWING

The preferred embodiments of this invention illustrating all its features will now be discussed in detail. These embodiments depict the novel and unobvious features of the fence support of this invention. The drawing accompanying this application, which is for illustrative purposes only, includes the following figures wherein like numerals indicate like parts.

DETAILED DESCRIPTION OF THE PREFERRED EMBODIMENT

Figure 1:
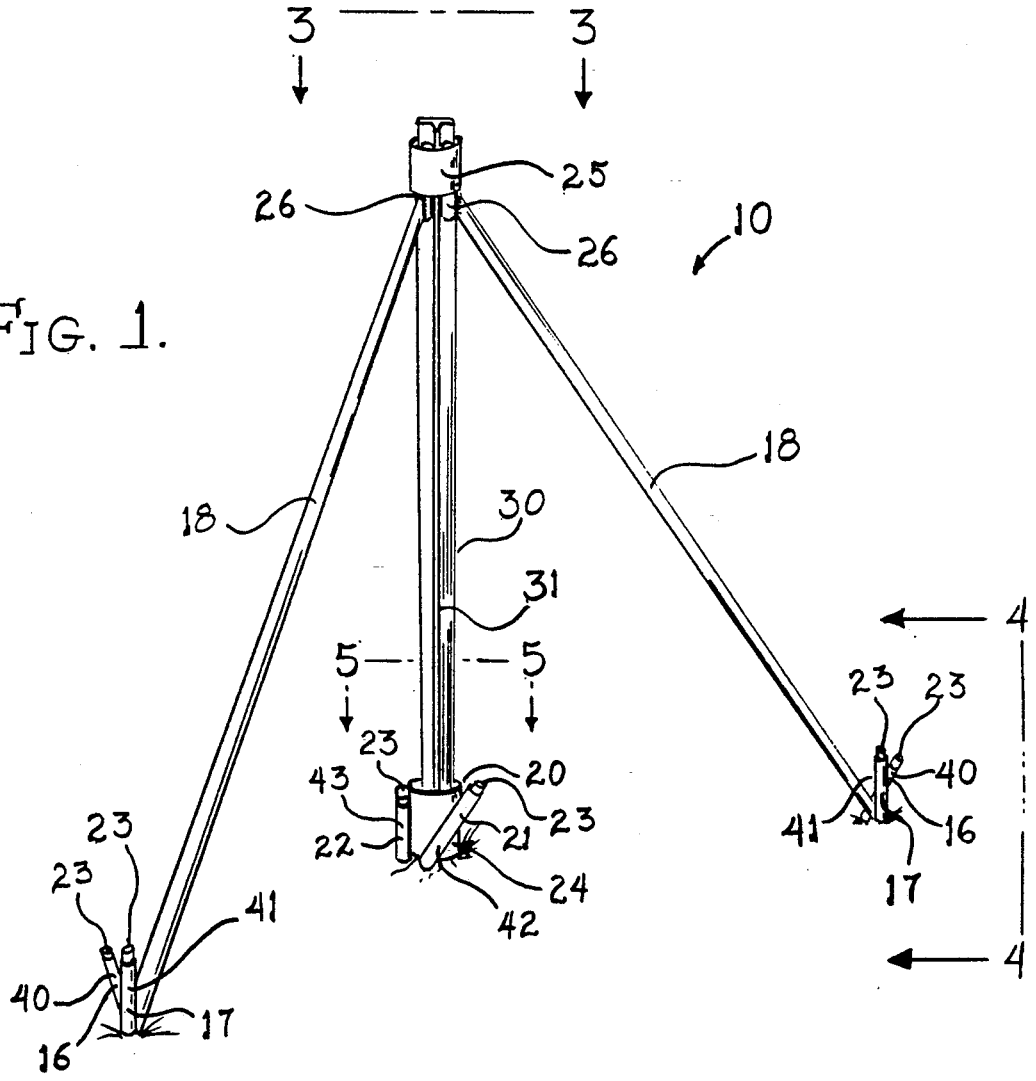
FIG. 1 is a perspective view of the fence support of this invention used as a corner support.
Figure 2:
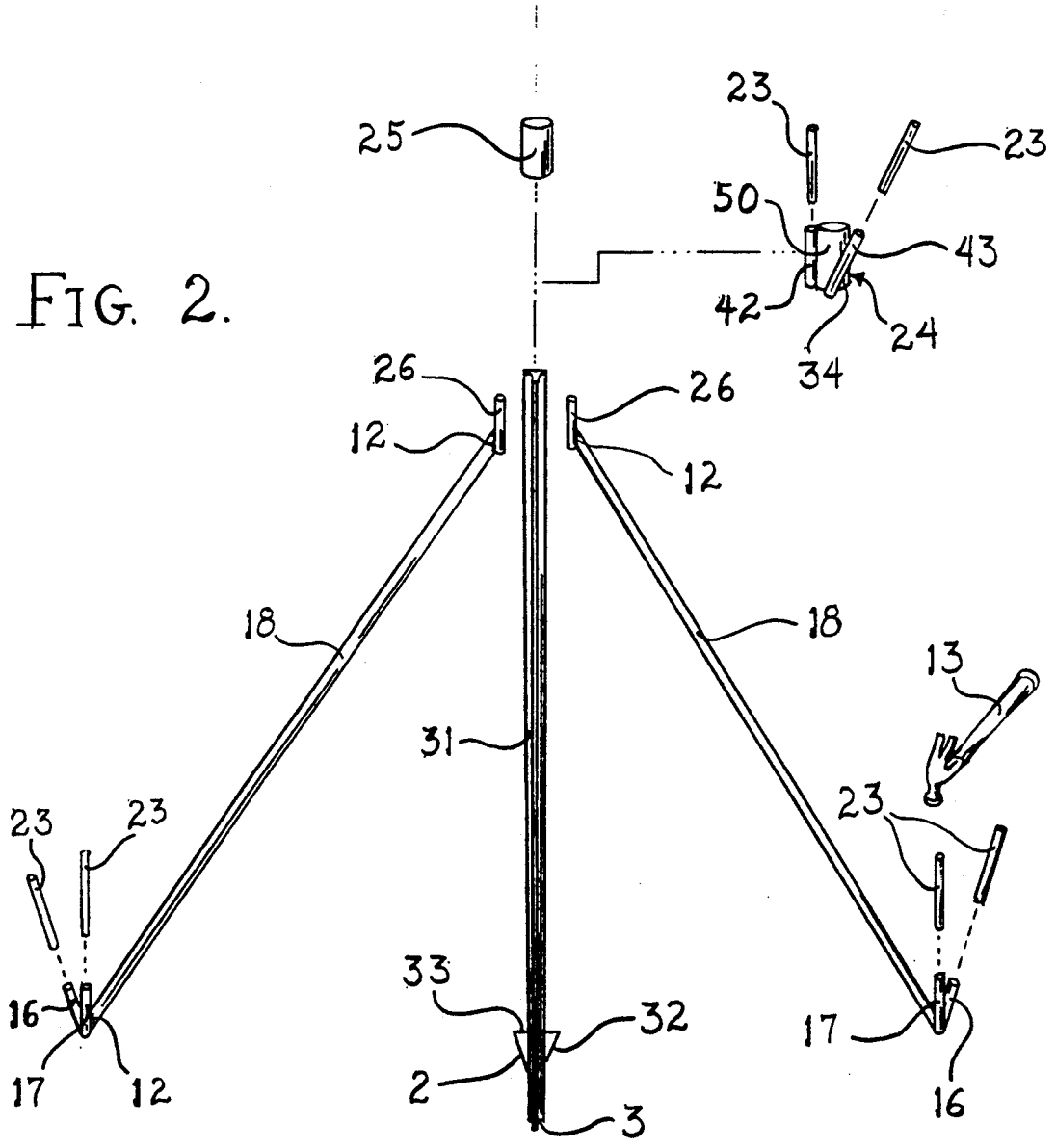
FIG. 2 is an exploded perspective view of the fence support shown in FIG. 1.

As best illustrated in FIGS. 1 and 2, the fence support 10 of this invention includes a main support post 31 and a pair of braces 18. Preferably, the main support post 31 and braces 18 are made of a rigid material, preferably iron or steel.

The main support post 31 ranges in length from about three to eight feet depending upon the height of the fence, and typically is five feet long. A T-bar is suitable, but other configurations such as wooden posts, either square or round cross-section, metal tubes, and angle irons may be used as the main support post. At approximately six inches to two feet from the bottom end of the main support post 31 is a triangular plate 32 which is attached to the cross bar 1 of the T-bar used as the main support post 31, with the apex 2 pointing downwardly toward the bottom end 3 of the main support post. When the main support post 31 is driven into the ground, the upper surface 33 of the triangular plate 32 is essentially flush with the ground surface 4. In very hard soils it may be expedient to drive the main support post 31 only about six inches into the ground. Depending on the position of the plate 32, this may result in the plate being several inches above the ground surface 4. This is acceptable as will be explained in greater detail subsequently.

Figure 8:
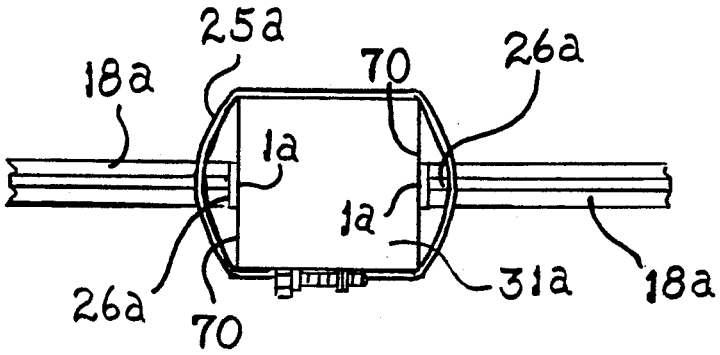
FIG. 8 is a plan view of a third embodiment of the fence support of this invention.
Figure 10:
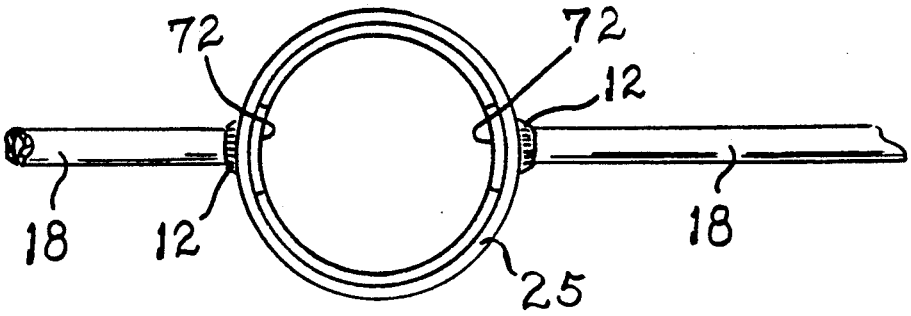
FIG. 10 is a plan view of a forth embodiment of the fence support of this invention.

Since the T-bar used as the main support 31 is relatively thin, having a width of approximately ⅝ to 1½ inch, it is easily driven into the ground manually with little effort. When a T-bar is used as the main support post 31, the leg 5 of the T bar intersects the central part of the cross bar 1 to form on either side of the leg at the top of the main support post 31 a pair of opposed mating surfaces 6 and 7. As illustrated in FIGS. 8 and 10, the main support member 31 may have cross-sectional configurations other than a T, thereby providing different types of mating surfaces. In FIG. 8 the mating surface is simply a flat surface and in FIG. 10 the mating surface is a curved, exterior section of a cylinder.

Figure 3:
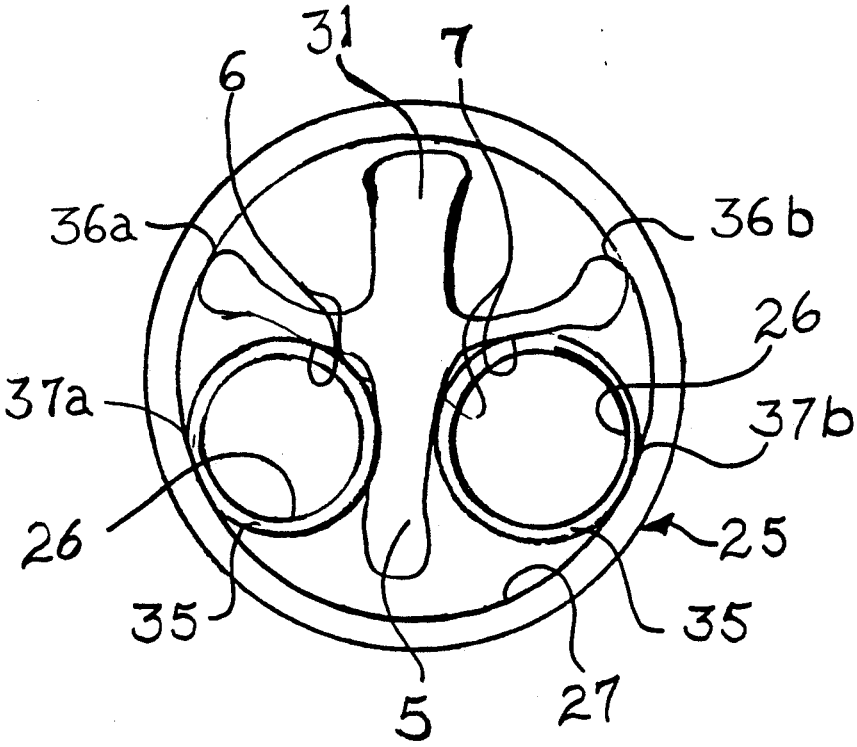
FIG. 3 a cross-sectional view taken along like 3—3 of FIG. 1.
Figure 3:
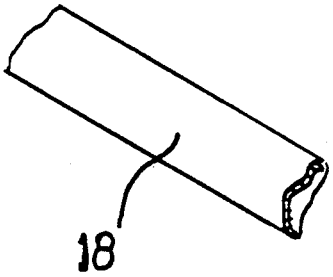
Figure 4:
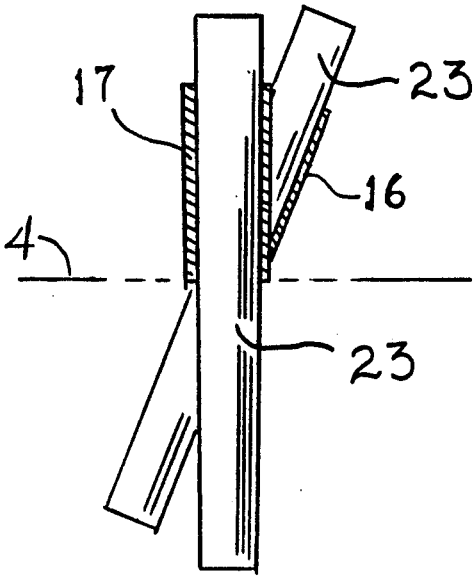
FIG. 4 a side elevational view, partly in cross-section with e broken away, showing the stake holder.

Each of the braces 18 is a generally elongated component made, for example, of angle iron. At the top end of each brace 18 is an elongated bearing element 26, which, upon assembly of the braces and main support post 31 as illustrated in FIG. 3, engages and bears against the mating surfaces 6 or 7 as the case may be. At the bottom end of each of the braces are stake holders 16 and 17. Preferably, the two stake holders 16 and 17 are employed. The one stake holder 17 is generally parallel to the main support post 31 when this post is driven into the ground to assume a generally vertical orientation. The other stake holder 16 is at an acute angle with respect to the main support post 31. It has been found that if this acute angle is about 15 degrees with respect to the vertically oriented main support post 31, superior performance is achieved in hard soil and the fence support 10 is able to carry more weight than, for example, if this stake holder 16 was at an angle of approximately 45 degrees. The leading edges 35 of the bearing elements 26 are preferably beveled to assist in assembly.

Each of the stake holders 16 and 17 consist of a generally tubular element having a diameter that is sufficient to allow stakes 23 to slip into the tubular element. These tubular elements are attached, for example by welding (welded joints are indicated by the number 12 for all welds), to the bottom ends of the braces 16 and 17 to form a rigid triangular type supporting structure at the end of each of the braces. It has been found that when the fence support 10 is to be used as a line support, rather than a corner support, the one stake holder 16 may usually be eliminated, provided the soil conditions are favorable.

Figure 5:
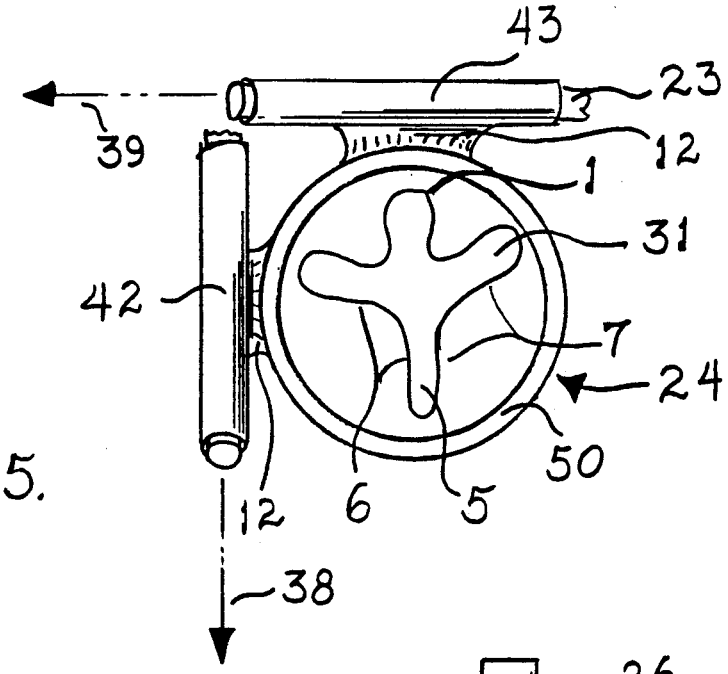
FIG. 5 is a cross-sectional view taken along line 5—5 of FIG. 1.

Although not required in all instances, it is sometimes desirable to use an anchor 24 to hold the main support post securely in position and minimize the likelihood of vaulting. This anchor 24 comprises a pair of tubes 42 and 43 attached to the exterior of a generally tubular member 50 that fits over the top of the main support post 31 and slides down along the length of the main support post to have its lower surface 34 engage the upper surface 33 of the plate 32. The tubes 42 and 43 are at acute angles with respect to the vertically oriented main support post 31 and are generally at right angles with respect to each other as depicted in FIG. 5. The tubes 42 and 43 are attached, for example by welding, to the tubular member 50. Stakes 23 are received in the tubes 42 and 43 and driven into the ground.

As best illustrated in FIG. 3, when the main support post 31 and braces 18 have been assembled, the elongated bearing elements 26 fit snugly against the mating surfaces 6 and 7 and a collar member 25 in the form of a hollow cylindrical element is force fitted over the assembly of bearing elements and main support post. The collar member 25 thus holds the braces 18 and main support post 31 snugly together at the upper end, with the collar member pulling the ends 36*a* and 36*b* of the cross bar 1 and the surfaces 37*a* and 37*b* of the bearing elements 26 tightly against the inside surface of the collar member. The braces 18 may be aligned so they are in the same plane as each other and as the main support post 31, or oriented so that the braces are generally at right angles. A line support is formed when the main support post 31 and braces 18 all lie in the same plane. A corner support is formed when the main support post 31 and one brace 18 lies in the same plane (reference plane) and the other brace 18 lies in another plane which is at right angles to the reference plane.

In accordance with an alternate embodiment of this invention, an elongated bearing member 26a may be mounted by a hinge 52. This hinge 52 includes a bit 45 which is received in a clevis 54. A pin 46 extends between aligned holes 55 in the clevis 54 and passes through the hole 56 in the bit 45. This type of bearing element 26a allows the brace 18 to be oriented at an angle which can be varied, so that the fence support 10 may be installed in hilly terrain.

INSTALLATION OF THE FENCE SUPPORT

The fence support 10 of this invention is easy to install and the installation time generally takes less than five minutes. First, the installer drives the main support post 31 into the ground so that this main support post is generally vertically oriented and the top edge 33 of the plate 32 is approximately flush with the ground surface 4. In very hard soil the plate edge 33 will not be flush with the ground surface 4 but will be several inches above it. Under such conditions the anchor 24 is used. The installer aligns the tubular member 50 of the anchor 24 with the upper end of the main support post 31 and slides the anchor down toward the plate 32 so that the lower edge 34 of the tubular member 50 rests against the edge 33 of the plate. Using a hammer 13, the installer simply drives the stakes 23 into the ground, first putting one stake into the holder 42 and another stake into the holder 43. Even when the anchor 24 is not flush with the surface of the ground, for example when the main support post 31 is only driven a few inches into the ground and the plate 32 is above the surface of the ground, the stacks 23, being sufficiently long, are driven deep into the ground to hold the main support post firmly in position.

The importance of the anchor 24 is better appreciated by considering the problem of vaulting. By using the anchor 24 this problem is avoided in many cases, and even if vaulting occurs, the main support post 31 and braces 18 are restacked into a new position very close to the old position. This simple procedure of restaking allows the installer to solve an otherwise extremely difficult problem. Because the anchor 24 is positioned above the plate 32 and engaging the plate and because it is staked in position, it is very difficult for the tension in the fencing material to pull the fence support 10 from the ground.

With the main support post in the upright vertical position in the ground, the installer then aligns the braces 18 as required to bring their top ends into position next to the top end of the main support post 31. The collar member 25 is loosely placed over the assembly of the top ends of the main support post 31 and braces 18, but not force fitted over this assembly at this time. This is accomplished by slipping the assembly of ends of the elongated bearing elements 26 into the collar member 25. The beveled edges 35 of the bearing elements facilitate this assembly.

The braces 18 are positioned so that their upper ends abut the upper end of the main support post 31, with the elongated bearing members 26 pressing firmly against the mating surfaces 6 and 7. If a line support is to be made, the braces 18 are aligned with each other and the main support post 31 to all lie in the same plane. If a corner support is to be made, one of the braces is oriented so that it is generally at right angles with respect to the plane in which the other brace and main support post 31 lie, as illustrated in FIG. 1.

The next to the last step in the assembly of the fence support 10 is to insert stakes 23 into the stake holders 16 and 17 of the braces 18 and drive these stakes into the ground. The stakes 23 will generally have a length ranging from one to three feet.

The final step is for the installer to strike the top of the collar member 25 with the hammer 13 to force fit it over the assembly of the ends of the main support post 31 and braces 18 to rigidly and fixedly attach the post and braces together. This creates a three legged structure which is extremely sturdy and can carry very heavy loads. The fence support 10 may be disassembled by knocking off the collar member 25 with the hammer 13.

Figure 6:
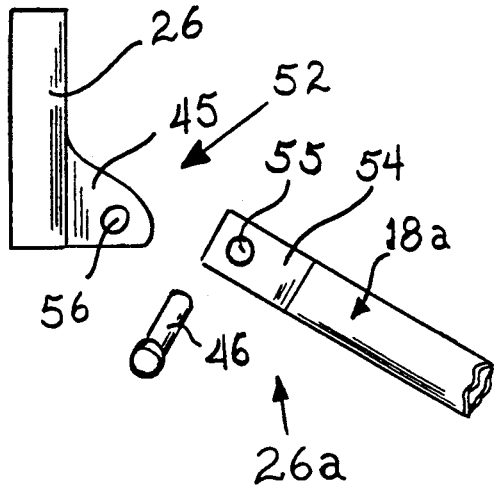
FIG. 6 is a fragmentary end view of a second embodiment of this invention illustrating a disassembled hinged elongated bearing member.
Figure 7:
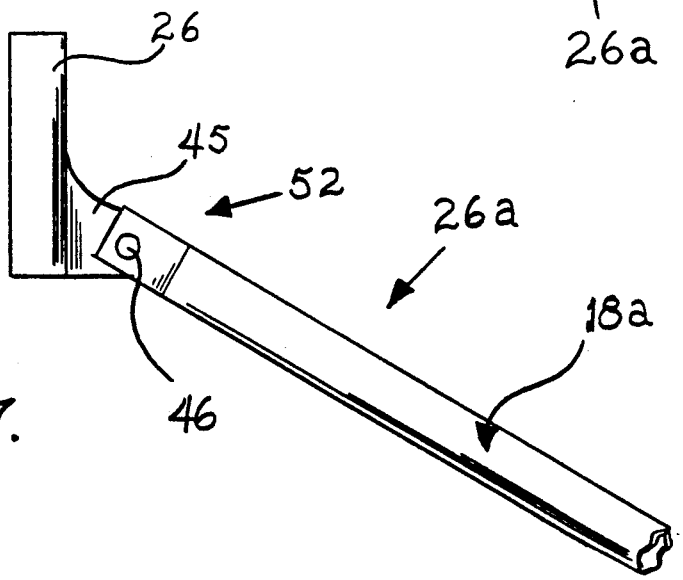
FIG. 7 is an elevational view similar to FIG. 6 with the components assembled.

In hilly terrain it is necessary that the braces 18 form different angles with respect to the main support post 31 depending upon the slope of the hill where the fence support 10 is being located. In such situations the braces 18a depicted in FIGS. 6 and 7, which allow the brace angle to be varied to accommodate the hilly terrain, are used. This type of brace 18ais used in essentially the same way as that shown in FIGS. 1 and 2, except that the installer will adjust the angle between the elongated bearing element 26 and the clevis 54 as required by the terrain, and then with this angle set, place stakes 23 into the stack holders 16 and 17 and drive the stakes into the ground.

ALTERNATE EMBODIMENTS OF THE FENCE SUPPORT

Figure 9:
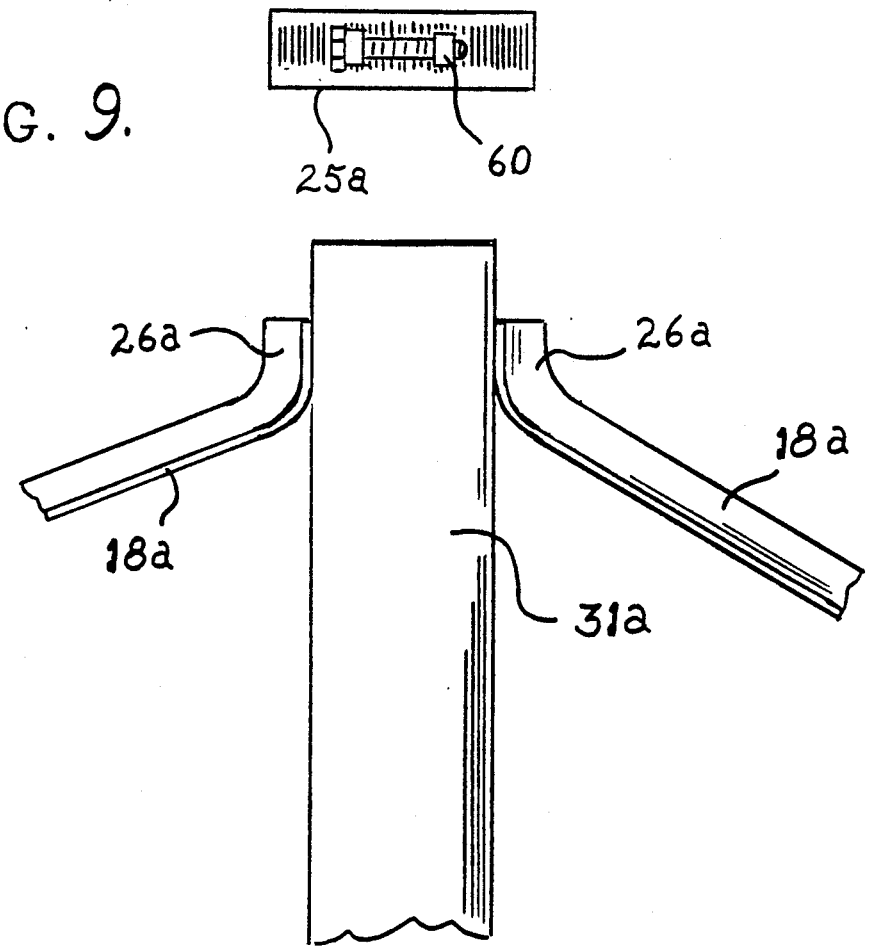
FIG. 9 is a side elevational view, with the cap member removed, of the third embodiment shown in FIG. 8.

As shown in FIGS. 8 through 11, the fence support may employ main support posts of different cross-sectional configurations. In FIGS. 8 and 9 a fence support 10a is illustrated with a main support post 31a made of wood and having a square cross-section. The braces 18a are T-bars which are bent outwardly at their ends to form elongated bearing elements 26a. In this arrangement the cross bars 1a rest against the flat mating surfaces 70 of the exterior of the wooden main support post 31a. A conventional strap 25a is used as the collar member. Upon assembly, a screw closure 60 is tightened to hold the main support post 31a and braces 18a together firmly. Loosing the screw closure 60 allows the fence support to be easily disassembled.

Figure 11:
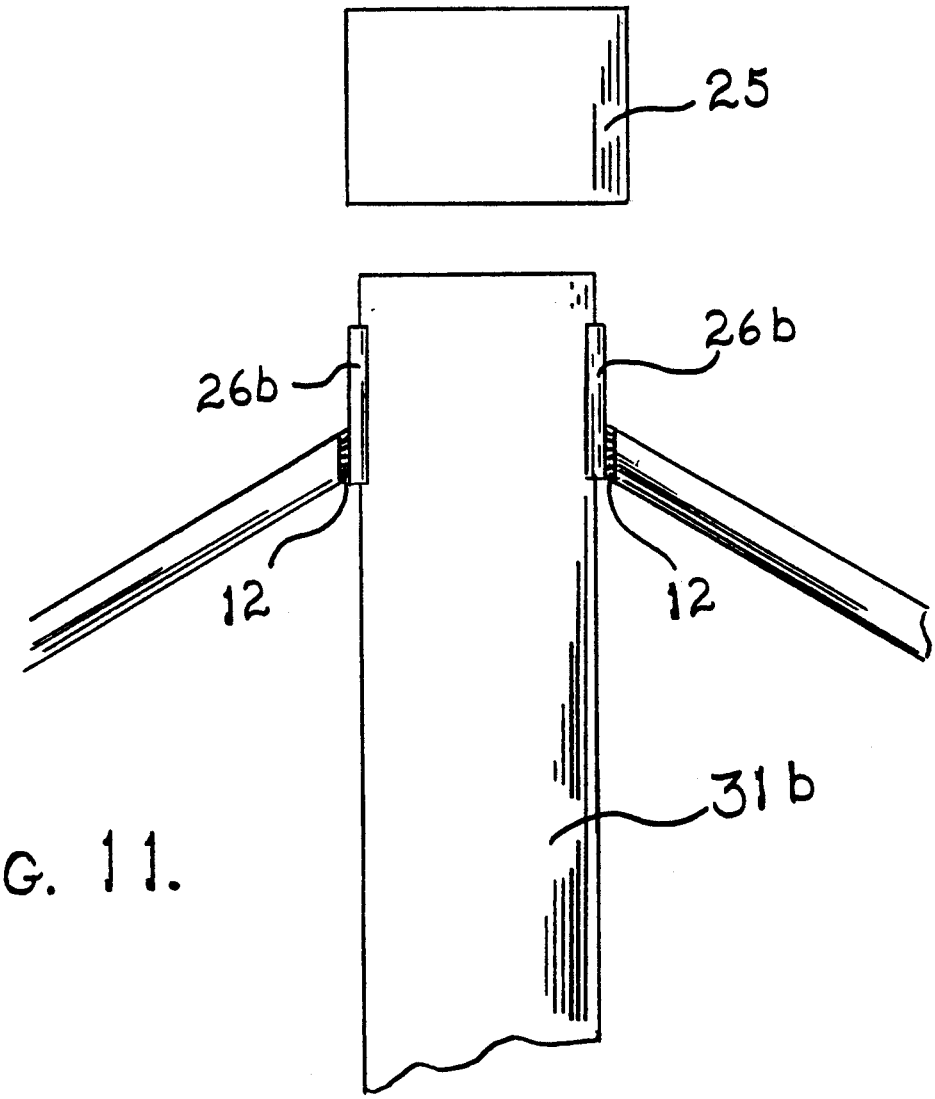
FIG. 11 is aside elevational view, with the cap member removed, of the forth embodiment shown in FIG. 10.

FIGS. 10 and 11 illustrate a fence support 10b using a main support post 31b having a circular cross-section. In this situation the exterior wall 71 of the post 31b provides the mating surface which is in the form of a segment of a cylinder. The elongated bearing elements 26b are shaped to conform to the wall 71, that is, they include a concave surface 72 which upon assembly abuts the wall 71.

Figure 12:
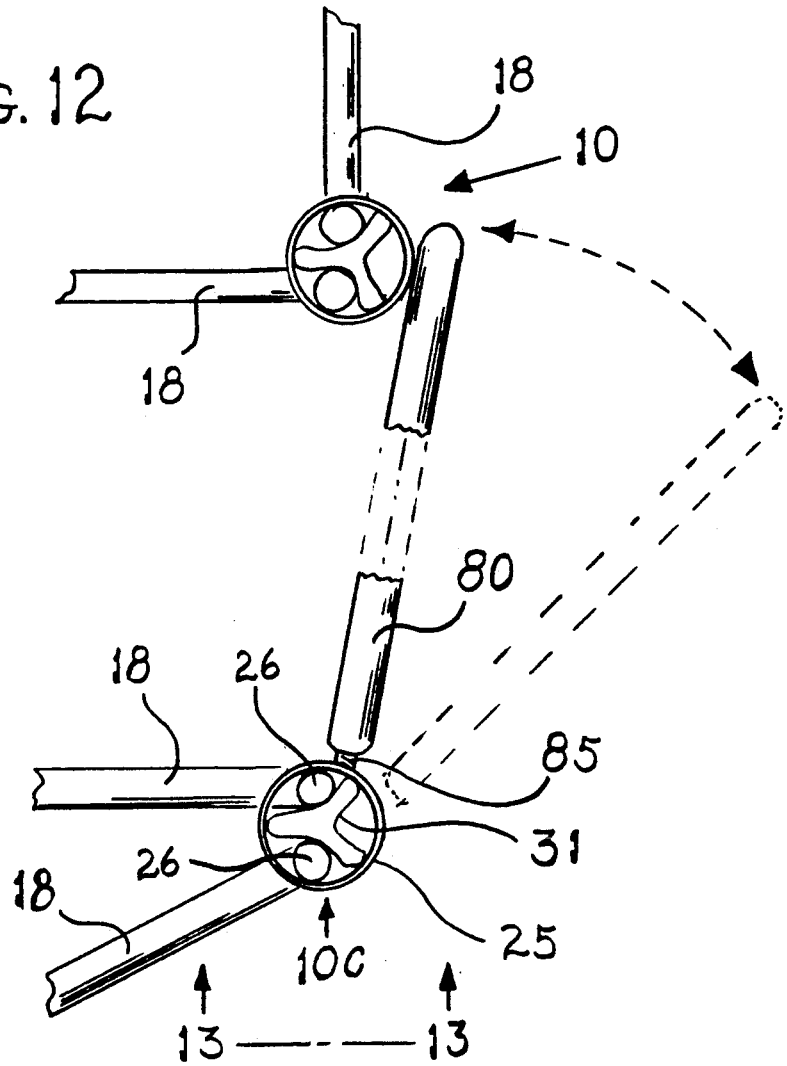
FIG. 12 is a fragmentary plan view of the fence support illustrated in FIG. 1 modified to hold a gate.
Figure 13:
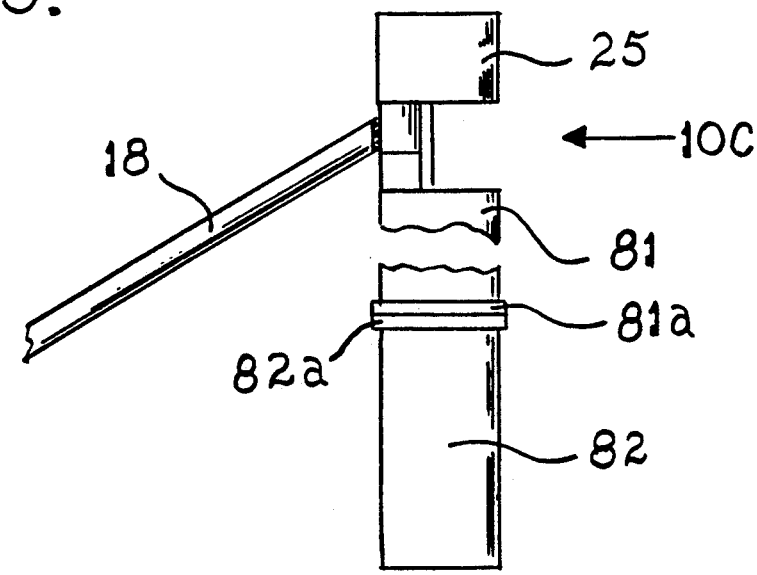
FIG. 13 is an end view taken along line 13—13 of FIG. 13.

FIGS. 12 and 13 show a fence support 10c used to support a gate 80. This fence support 10c is essentially the same as that shown in FIG. 1, except that a pair of tubes 81 and 82 are disposed between the collar member 25 and the anchor 24. Each of the tubes 81 and 82 has a terminal flange 81a and 82b respectively which bear against each other. The tube 81 has threaded studs 85 which are received in the gate 80 and bolts (not shown are secured to the studs to attach the gate to the tube 81. It was found upon testing that the braces could be at an angle of only 12°. Typically the angle between the braces 18 for all applications will range between 12° (gate supports) and 180° (line supports). Surprisingly, a young boy for example can climb on the end of the gate 80 a swing on the gate and the fence support 10*c* will still be able to carry the load.

SCOPE OF THE INVENTION

The above description presents the best mode contemplated of carrying out the present invention. This invention is, however, susceptible to modifications and alternate constructions from the embodiments shown in the drawing and described above. Consequently, it is not the intention to limit this invention to the particular embodiments disclosed. On the contrary, the intention is to cover all modifications coming within the spirit and scope of the invention as generally expressed in the following claims.

I claim:

1. A fence support comprising a main support post having a top end and a bottom end adapted to be forced into the ground to orient the main support post generally vertically, said main support post having a generally T-cross section at the top end to form at the intersection between a cross bar of the T-cross section and a leg of the T-cross section a pair of corners, a pair of braces, each brace having a top end and a bottom end including stake holder means, a pair of elongated hearing elements, each of said elongated bearing elements being mounted by hinge means to the top ends of said braces, said main support post and braces being adapted to be assembled into said fence support wherein the elongated bearing elements engage the top end of the main support post, with each elongated bearing element received in one of said corners, an anchor element removably attached to the lower end of the main support post which receives the bottom of the main support post, said anchor element including stake holder means with stakes receive therein and driven into the ground, a collar member force fitted over the top of the main support post and the elongated bearing elements, attaching said main support post and elongated bearing elements rigidly and fixedly together, and stakes received in the stake holder means of said braces and driven into the ground.

* * * * *